United States Patent [19]

Itoh et al.

[11] Patent Number: 4,966,120

[45] Date of Patent: Oct. 30, 1990

[54] FUEL INJECTION SYSTEM ASSEMBLY

[75] Inventors: Hideki Itoh; Hitoshi Takeuchi, both of Obu, Japan

[73] Assignee: Aisan Kogyo Kabushiki Kaisha, Obu, Japan

[21] Appl. No.: 225,724

[22] Filed: Jul. 28, 1988

[30] Foreign Application Priority Data

| | | | |
|---|---|---|---|
| Jul. 29, 1987 | [JP] | Japan | 62-189795 |
| Jul. 30, 1987 | [JP] | Japan | 62-191133 |
| Jul. 31, 1987 | [JP] | Japan | 62-193369 |
| Feb. 5, 1988 | [JP] | Japan | 63-26307 |

[51] Int. Cl.[5] ..... F02M 39/00

[52] U.S. Cl. ..... 123/516; 123/456; 123/470

[58] Field of Search ..... 123/516, 456, 470, 468, 123/469, 471, 472, 52 M

[56] References Cited

U.S. PATENT DOCUMENTS

| | | | |
|---|---|---|---|
| 4,079,717 | 3/1978 | Shirose | 123/516 |
| 4,341,193 | 7/1982 | Bowler | 123/472 |
| 4,416,238 | 11/1983 | Knapp | 123/470 |
| 4,436,071 | 3/1984 | Hafner | 123/472 |
| 4,516,555 | 5/1985 | Shioya | 123/470 |
| 4,527,528 | 7/1985 | Finn | 123/456 |
| 4,539,961 | 9/1985 | Atkins | 123/516 |
| 4,601,275 | 7/1986 | Weinand | 123/516 |
| 4,726,337 | 2/1988 | Yoshida | 123/432 |

FOREIGN PATENT DOCUMENTS

| | | | |
|---|---|---|---|
| 8802067 | 3/1988 | European Pat. Off. | 123/470 |
| 1229142 | 9/1960 | France | 123/470 |
| 59-34473 | 2/1984 | Japan | 123/470 |
| 61-88061 | 6/1986 | Japan | 123/470 |
| 6124544 | 6/1986 | Japan | 123/470 |
| 61-193522 | 8/1986 | Japan | 123/470 |
| 62-210260 | 9/1987 | Japan | 123/470 |

*Primary Examiner*—Carl Stuart Miller

*Attorney, Agent, or Firm*—Dennison, Meserole, Pollack & Scheiner

[57] ABSTRACT

An assembly for a fuel injection system for use with an internal combustion engine, comprises a fuel injection system component and a plurality of injectors mounted on the component. The component comprises a plurality of air passages for supplying air into the engine, a plurality of injector seats and a fuel passage communicating with the injector seats. Each injector has a vapor discharge passage communicating with the inside of the injector and with the fuel passage, and/or has a filter inserted in the fuel passage so that fuel vapor in the injector is smoothly discharged from the injector into the fuel passage, thereby preventing vapor lock of the injector system. The component may be directly mounted to a surge tank so that an independent intake manifold need not be used.

11 Claims, 16 Drawing Sheets

FUEL INJECTION SYSTEM ASSEMBLY

BACKGROUND OF THE INVENTION

The present invention relates to an assembly for a fuel injection system for use with an internal combustion engine, and more particularly to an assembly for a fuel injection system of a type such that a fuel injector is provided for each cylinder of the engine.

In general, a fuel injection system of this type includes fuel injectors mounted adjacent to a cylinder head of the engine in an engine compartment. As a result, each of the injectors tends to be heated by heat of the engine, so that temperature of the injector is increased, which may cause the generation of fuel vapor. If the fuel vapor is generated in the injector, a predetermined quantity of fuel cannot be injected during a predetermined operating period of time of the injector, causing a trouble that mixture of lean air-fuel ratio is supplied to the engine.

Generation of the fuel vapor in the injector mainly results from two causes. One is that fuel vapor generated in a fuel passage for supplying fuel to the injector is fed into the injector, while the other is that fuel vapor is generated in the injector itself. In order to prevent the generation of the fuel vapor due to the former cause, a technique is disclosed in Japanese Patent Publication No. 61-24544. However, the technique cannot prevent the generation of fuel vapor due to the latter cause. The latter cause tends to occur especially when the engine temperature remains high after the engine is stopped due to the stoppage of operation of an engine cooling system. In other words, if a measure to be taken for the latter cause is insufficient, troubles may occur at restarting of the engine.

In the conventional fuel injection system of the above type, each fuel injector is provided for each cylinder, and the fuel passage must be connected to each injector. The connection between the fuel injector and the fuel passage must be accurately effected so that the fuel may not leak out. As a result, mounting operation becomes troublesome and machining accuracy of each part must be kept high, which in general causes an increase in manufacturing cost of such a fuel injection system.

The fuel injection system of the above type includes a further problem in responsiveness of the engine, because, when atomized fuel injected from the injectors is deposited on inner walls or the like of an intake manifold, it may take more time for the injected fuel to reach the cylinders of the engine. In order to avoid this problem, it is required to provide a structure ensuring that the injected fuel can reach the cylinders of the engine as smoothly as possible.

SUMMARY OF THE INVENTION

The present invention is intended to provide an assembly for a fuel injection system which can eliminate the above described problems.

A first object of the present invention is to prevent occurance of the trouble that the fuel injection quantity does not come to a predetermined value due to the generation of fuel vapor in the injectors. In order to achieve this object, the present invention provides an assembly so constructed as to permit the fuel vapor in the injectors to be rapidly discharged therefrom.

A second object of the present invention is to facilitate mounting of the injectors and the fuel passage onto the cylinder head of the engine. In order to achieve this object, the present invention provides an assembly in which the injectors are preliminarily connected with the fuel passage.

A third object of the present invention is to assure the fuel injected from the injectors is supplied to the cylinders of the engine as rapidly as possible. In order to achieve this object, the present invention provides an assembly so constructed as to permit the fuel injected from the injectors to directly reach suction ports of the engine.

A fourth object of the present invention is to provide an assembly for a fuel injection system adapted particularly for supplying fuel mixture to an engine of a type having two suction ports for each cylinder in such a manner that the mixture of rich air-fuel ratio is supplied through one of the suction ports and the mixture of lean air-fuel ratio is supplied through the other suction port. Accordingly, the combustion efficiency may be improved.

The invention will be more fully understood from the following detailed description and appended claims when taken with the drawings.

DETAILED DESCRIPTION OF THE PREFERRED EMBODIMENTS

Figure 1:
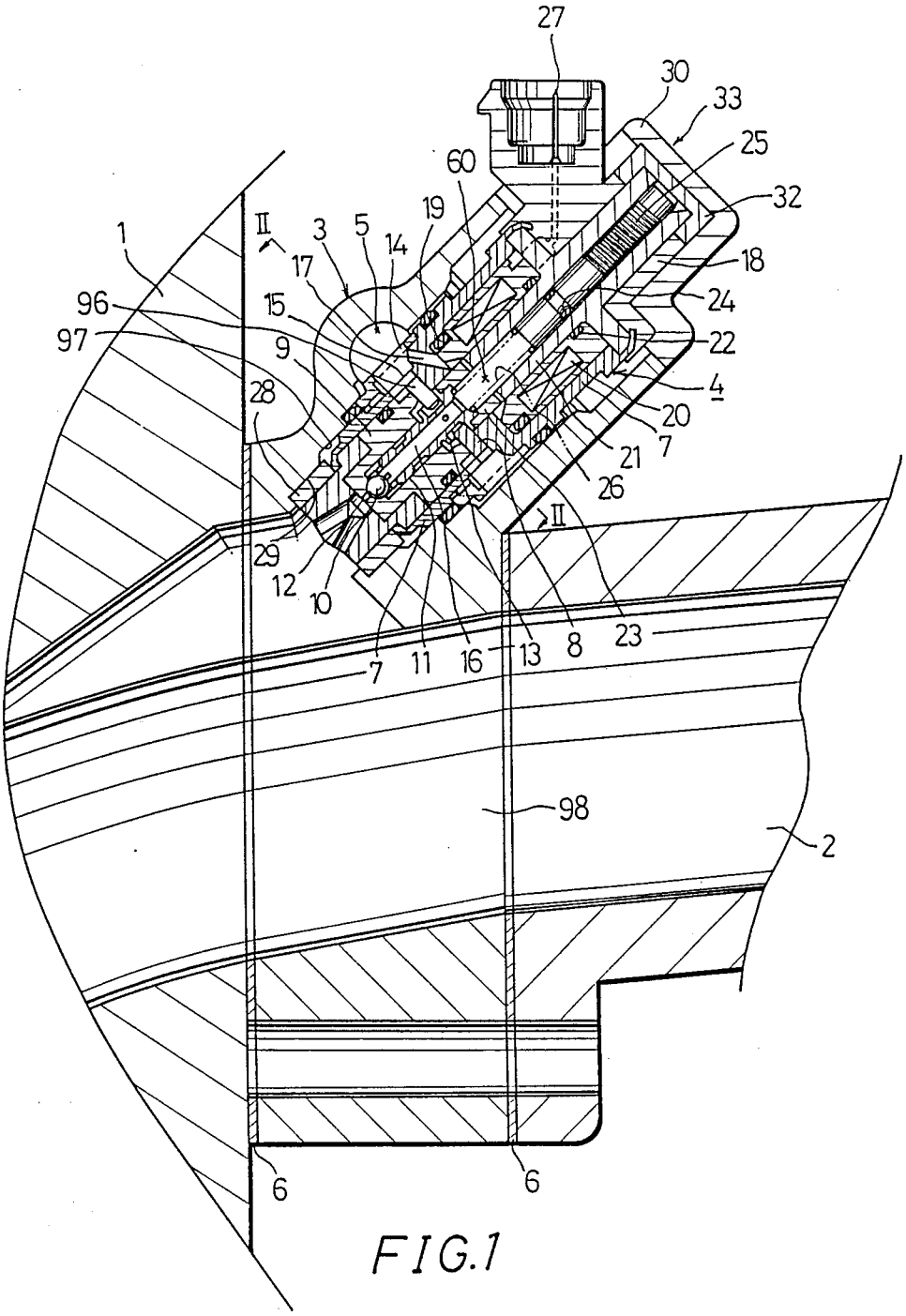
FIG. 1 is a sectional view of an assembly according to a first embodiment of the present invention.

There will now be described some preferred embodiments of the present invention wherein same or corresponding parts are designated by the same reference numerals.

Figure 2:
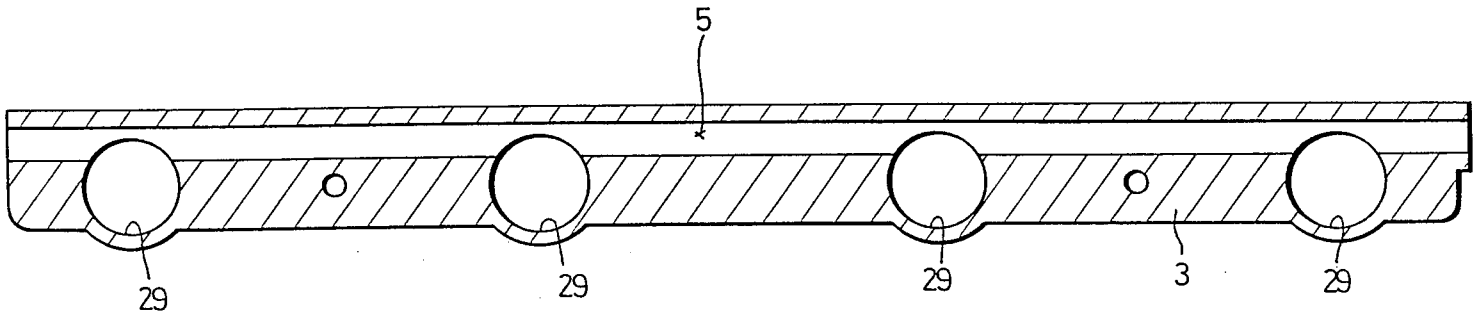
FIG. 2 is a sectional view of a fuel injection system component of the assembly shown in FIG. 1 as taken along the line II—II.
Figure 3:
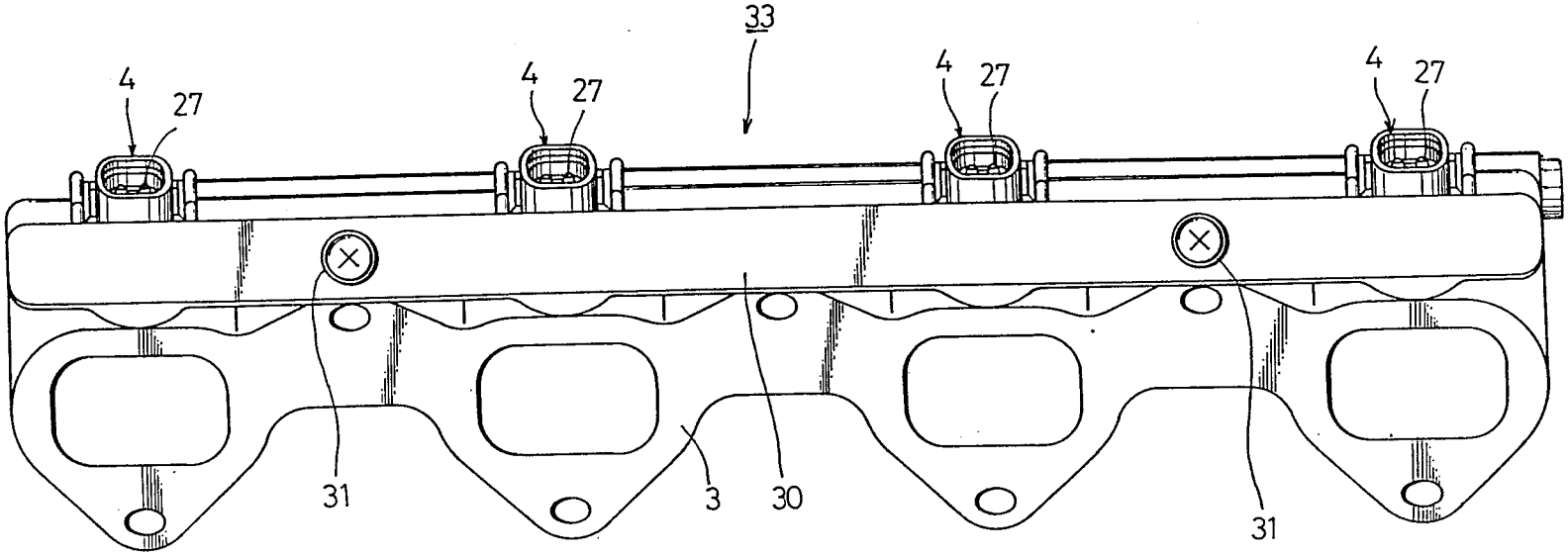
FIG. 3 is a front elevational view of the assembly in FIG. 1.

Referring first to FIGS. 1 to 3, reference numeral 33 generally designates a fuel injection system assembly mounted between a cylinder head 1 of an engine and an intake manifold 2 in an air-tight manner through gaskets 6 by bolts (not shown). The fuel injection system assembly 33 comprises a fuel injection system component 3 and a plurality of injectors 4. The component 3 is an integral member, and in the case that the component 3 is for use with a four-cylinder engine as will be hereinafter described in the embodiment, the component 3 has four air passages 98 each communicating each intake manifold 2 with each cylinder, a plurality of injector seats 97 each communicated with each air passage 98, and a fuel passage 5 communicated with each injector seat 97.

The assembly 33 is preliminarily assembled by mounting the injectors 4 onto the injector seats 97 and is interposed between the cylinder head 1 and the intake manifold 2.

Each of the injectors 4 includes a body 7 and a valve housing 9 mounted in the front end portion of the body 7 through a stopper 8. A valve 11 having at the front end thereof a ball 10 is received in the the valve housing 9 axially movably through a restricted stroke between an end surface of the stopper 8 and a valve seat formed around an injection hole 12 formed in the front end of the valve housing 9, so that, when the valve 11 is moved toward the injection hole 12 to bring the ball 10 into abutment against the valve seat, the injection hole 12 is closed to stop fuel injection therefrom. The valve 11 has a flange 13, and when the valve 11 is moved toward the stopper 8 to bring the flange 13 into abutment against the end surface of the stopper 8, the injection hole 12 is opened to supply fuel from the fuel passage 5 of the fuel injection system component 3 through a fuel filter 14 mounted on the outer periphery of the body 7 of the injector 4, a fuel inlet 15 formed in the outer periphery of the body 7, a radial slit 96 formed in the stopper 8 and a fuel passage 16 formed in the valve 11. Then, the fuel is injected from the injection hole 12.

The construction of the injection hole 12 and its associated parts is disclosed in detail in the specification and the accompanying drawings of Japanese Patent Application No. 61-193522 filed on Aug. 19, 1986 by the present applicant of this invention.

A solenoid coil 20 is mounted on the body 7 of the injector 4 through a connector 18 and a fuel seal 0-ring 19, and a hollow cylindrical fixed iron core 21 made of ferromagnetic material is inserted in the solenoid coil 20 through a fuel seal O-ring 22. There is mounted on the rear end of the valve 11 an armature 23 adapted to be attracted by the fixed iron core 21 when the solenoid coil 20 is excited. There is provided in a bore of the fixed iron core 21 a coil spring 26 disposed between a screw rod 25 threaded in the bore through a fuel seal 0-ring 24 and the armature 23 and adapted to urge the armature 23 in a direction opposite to the direction of attraction so as to force the ball 10 of the valve 11 against the valve seat around the injection hole 12.

In the above construction, a fuel storage chamber 60 is defined at a portion of the bore of the fixed iron core downstream of the O-ring 24. The body 7 of the injector 4 is formed in the side wall thereof with a vapor discharge passage 17 extending between the fuel storage chamber 60 and the fuel passage 5 sideways of the valve 11 at a position higher than the fuel storage chamber 60 and adapted to discharge fuel vapor stored in the fuel passage chamber 60 into the fuel passage 5.

The solenoid coil 20 is connected through a terminal 27 to an external circuit. The injector 4 is provided at its front end with a grommet 28 to be inserted into an injector mounting hole 29 formed in the fuel injection system component 3, and is provided at its rear end with a grommet 32 and a cover 30 to be firmly fixed by screws 31 to the component 3 (See FIG. 3). Thus, the injectors 4 are tightly assembled with the component 3, and are communicated with the fuel passage 5.

The construction of this embodiment operates as follows:

In the fuel injection system assembly 33 with this construction, the injector 4 is of a bottom feed type wherein excitation of the solenoid coil 20 by pulses from an electric control circuit (not shown) causes reciprocation of the armature 23 along with the valve 11, so that liquid fuel from the fuel passage 5 may be intermittently injected from the injection hole 12.

Immediately after the engine is stopped, cooling of the engine is also stopped, so that heat of the engine is confined in the engine compartment. As a result, fuel temperature is increased with the result of generation of fuel vapor in the injector 4. In this embodiment, the fuel vapor is once stored in the fuel storage chamber 60, and is then discharged from the fuel storage chamber 60 through the vapor discharge passage 17 into the fuel passage 5 located at a position higher than the fuel storage chamber 60. At restarting of the engine just after stoppage of the engine, for example, the fuel vapor is prevented from being mixed with the fuel to be supplied to the engine, thereby ensuring smooth restarting of the engine.

Fuel flow produced by the operation of a fuel pump at restarting of the engine often causes generation of fuel vapor at the fuel filter 14 in the injector 4. The fuel vapor is also once stored in the fuel storage chamber 60, and is then discharged therefrom through the vapor discharge passage 17 into the fuel passage 5 at a position higher than the fuel storage chamber 60, thereby permitting smooth restarting of the engine.

Figure 4:
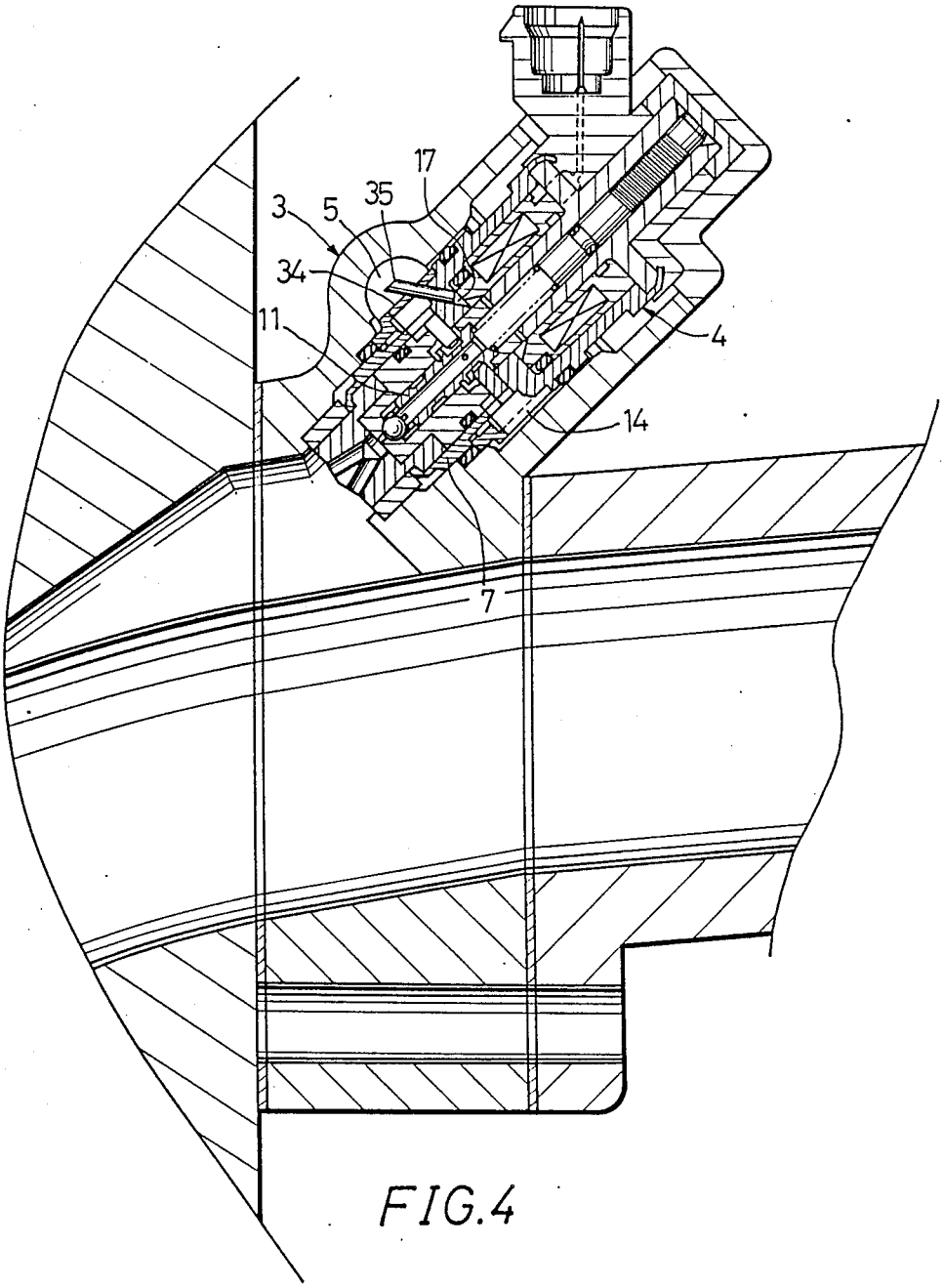
FIG. 4 is a sectional view similar to FIG. 1, illustrating a second embodiment of the present invention.
Figure 5:
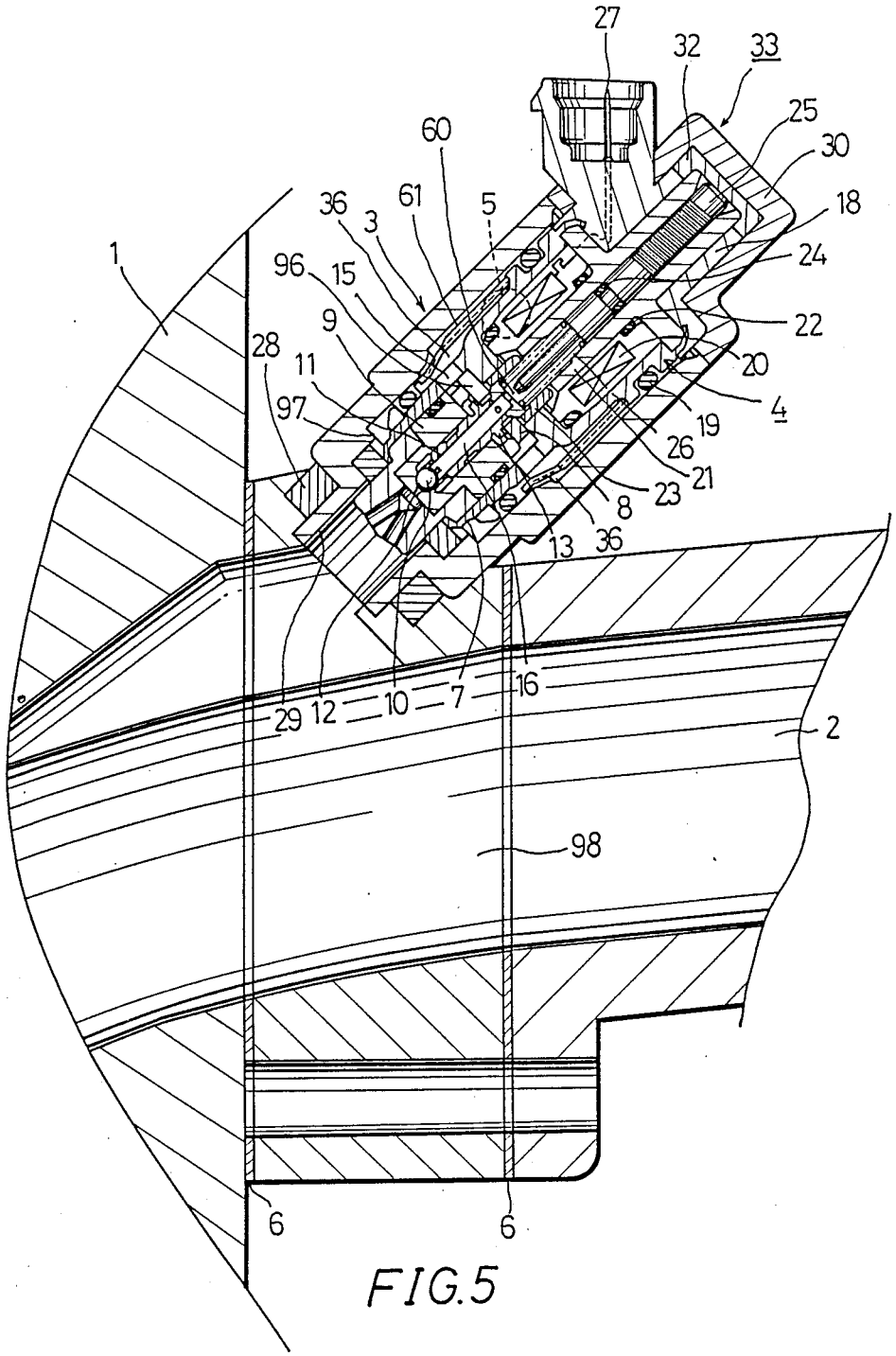
FIG. 5 is a sectional view similar to FIG. 1, illustrating a third embodiment of the present invention.
Figure 6:
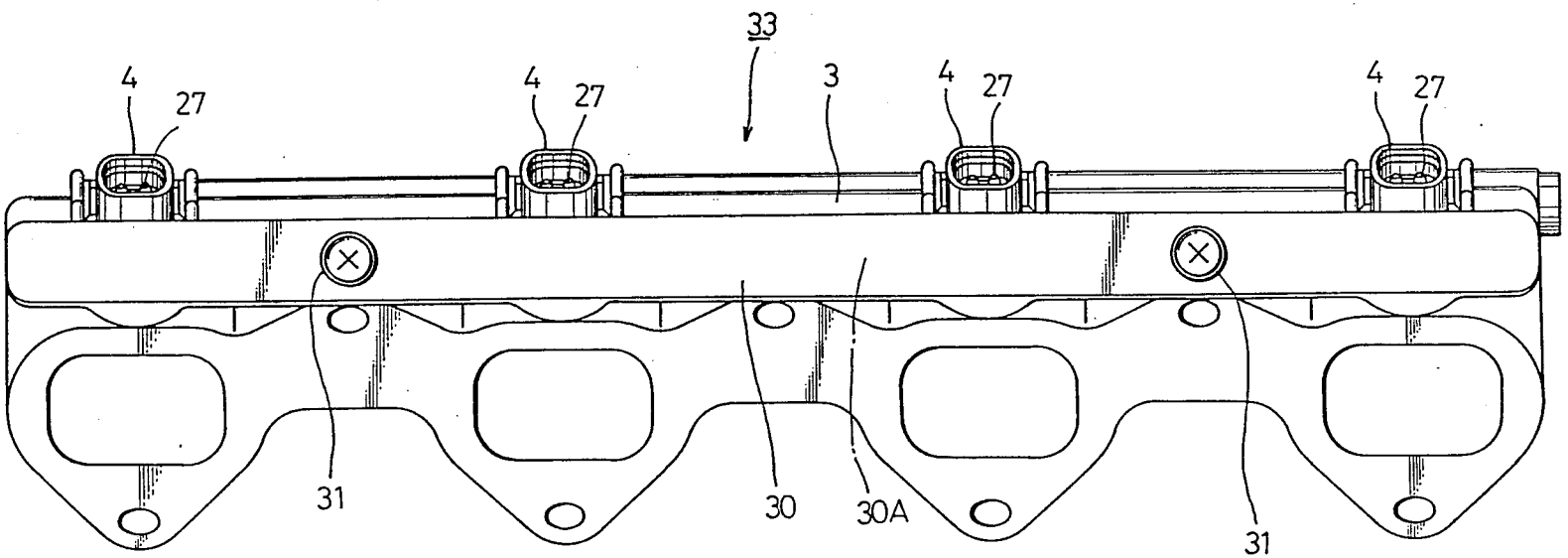
FIG. 6 is a front elevational view of the assembly of the third embodiment.
Figure 7:
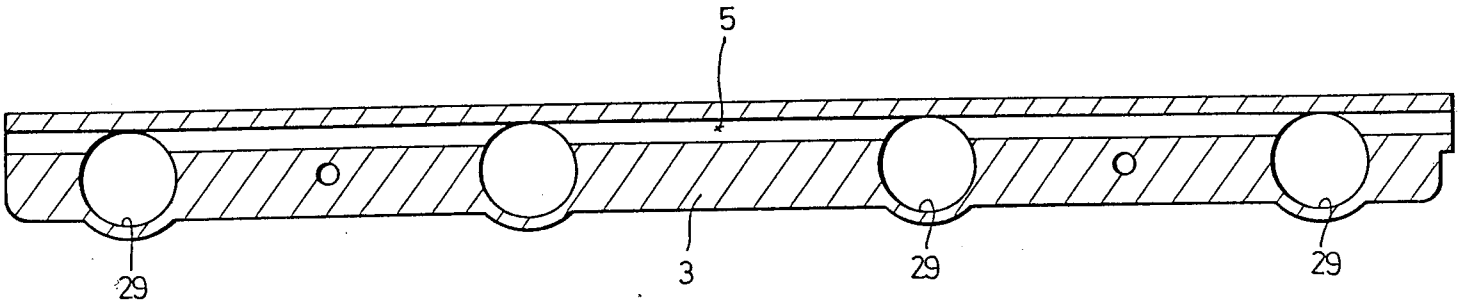
FIG. 7 is a sectional view similar to FIG. 2, illustrating the third embodiment.
Figure 8:
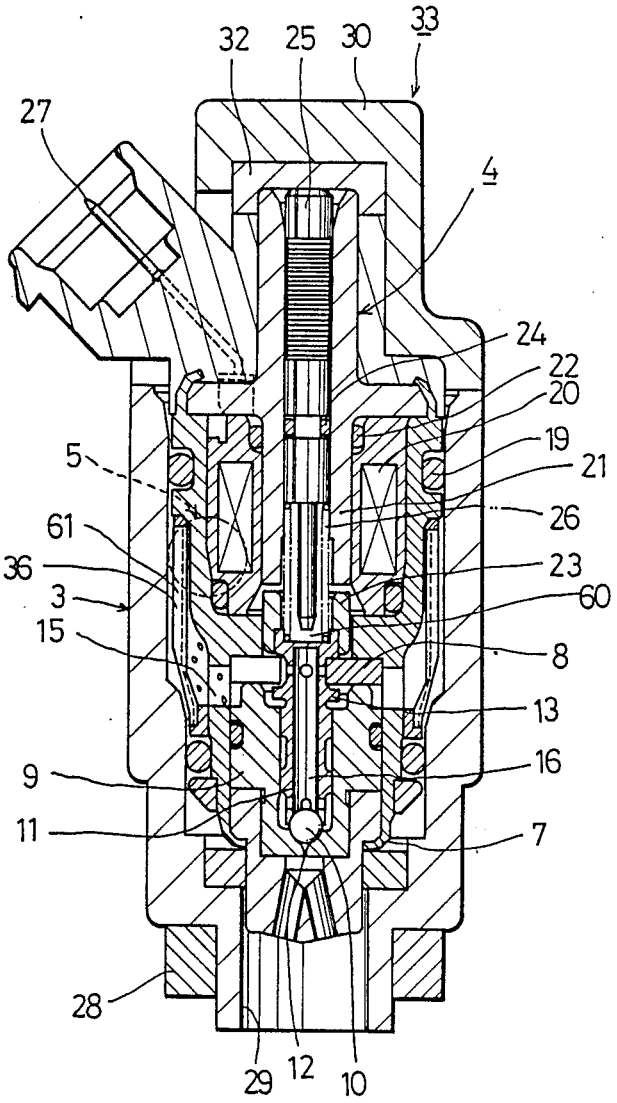
FIG. 8 is a sectional view of an injector for use with the assembly according to the third embodiment.

FIG. 4 shows a second embodiment of the present invention wherein same parts as in FIG. 1 are not numbered and the associated explanation thereof will be omitted for the simplicity. According to the second embodiment, the cylindrical fuel filter 14 mounted on the outer periphery of the body 7 of the injector 4 has a portion 34 interfering with the fuel passage 5 which portion 34 is left to constitute a part of the body 7 of the injector 4, so that a sectional area of the fuel passage 5 at this position becomes smaller, and accordingly the velocity of fuel flow is so increased as to generate a higher suction pressure around the injector 4. The fuel storage chamber 60 in the injector 4 is communicated with such a higher suction pressure zone around the injector 4 through a vapor discharge pipe 35 inserted in the vapor discharge passage 17 for discharging the fuel vapor, so that the fuel vapor stored in the fuel storage chamber 60 can be positively discharged therefrom into the fuel passage 5 due to the higher suction pressure. The second embodiment is similar to the first embodiment in construction, operation and effect excepting the above aspect.

In the first and second embodiments, the valve 11 is opened and closed by the solenoid coil 20, but the injector may employ a piezoelectric element in place of the solenoid coil 20.

With the arrangement of the assembly 33 of the first and second embodiments, even if the fuel vapor is generated in the injector 4 by the heat of the engine confined in the engine compartment immediately after the engine is stopped, and the fuel temperature is increased, the fuel vapor can be smoothly discharged into the fuel passage 5 of the fuel injection system component 3. At restarting of the engine, for example, the fuel vapor is prevented from making lean the mixture to be supplied to the engine, thereby ensuring smooth restarting of the engine.

A third embodiment of the present invention is shown in FIGS. 5 to 8. Reference numeral 33 generally designates a fuel injection system assembly mounted between a cylinder head 1 of an engine and an intake manifold 2 in an air-tight manner through gaskets 6 by bolts (not shown). The fuel injection system assembly 33 comprises a fuel injection system component 3 and a plurality of injectors 4. The component 3 is an integral member, and in the case that the component 3 is for use with four-cylinder engine as will be hereinafter described in the embodiment, the component 3 has four air passages 98 each communicating each intake manifold 2 with each cylinder, a plurality of injector seats 97 each communicated with each air passage 98, and a fuel passage 5 communicated with each injector seat 97.

The assembly 33 is preliminarily assembled by mounting the injectors 4 onto the injector seats 97 and is interposed between the cylinder head 1 and the intake manifold 2. In this embodiment, the fuel injection system component 3 is formed of a material having a high radiating capability of cooling the fuel, such as die cast aluminum having a high heat conductivity.

Each of the injectors 4 includes a body 7 and a valve housing 9 mounted in the front end portion of the body 7 through a stopper 8. A valve 11 having at the front end thereof a ball 10 is received in the the valve housing 9 axially movably through a restricted stroke between an end surface of the stopper 8 and a valve seat formed around an injection hole 12 formed in the front end of the valve housing 9, so that, when the valve 11 is moved toward the injection hole 12 to bring the ball 10 into abutment against the valve seat, the injection hole 12 is closed to stop fuel injection therefrom. The valve 11 has a flange 13, and when the valve 11 is moved toward the stopper 8 to bring the flange 13 into abutment against the end surface of the stopper 8, the injection hole 12 is opened to supply fuel from the fuel passage 5 of the fuel injection system component 3 through a fuel filter 14 mounted on the outer periphery of the body 7 of the injector 4, a fuel inlet 15 formed in the outer periphery of the body 7, a radial slit 96 formed in the stopper 8 and a fuel passage 16 formed in the valve 11. Then, the fuel is injected from the injection hole 12.

There is provided around the outer side wall of the body 7 of the injector 4 a fuel flow passage 36 which completes communication between a fuel storage chamber 60 at the rear end of the valve 11 which chamber in this case also serves as a surge tank for preventing turbulent flow of fuel and the fuel passage 5 formed at a position higher than the fuel storage chamber 60, so that the fuel vapor may be discharged therethrough from the fuel storage chamber 60. The fuel flow passage 36 provides a space for mounting the filter 61. In this embodiment, a part of the filter 61 mounted in the fuel flow passage 36 is inserted in the fuel passage 5 to form a vapor discharge means.

The rear end surface of each injector 4 is pressed through a grommet 32 and a cover 30 by fastening the screws 31 to the component 3. The cover 30 is formed of a material having a high radiating capability of cooling the fuel, such as die.cast aluminum which is a light metal having a high heat conductivity. With the attachment of the cover 30, there is defined a noise suppressing chamber 30A between the fuel injection system component 3 serving as a radiating plate and the cover 30.

The construction of this embodiment operates as follows:

In the fuel injection system assembly 33 with this construction, the injector 4 is of a bottom feed type wherein excitation of the solenoid coil 20 by pulses from an electric control circuit (not shown) causes reciprocation of the armature 23 along with the valve 11, so that liquid fuel from the fuel passage 5 may be intermittently injected from the injection hole 12. Even if the engine temperature is increased, the temperature of at least the fuel flowing through the fuel injection system component 3 which has a high radiating capability of cooling the fuel can be kept relatively low. Furthermore, as a part of the filter 61 mounted in the fuel flow passage 36 is communicated with the fuel passage 5, the fuel in the fuel passage 5 flows through the part of the filter 61 of the injector 4, so that the fuel vapor generated in the injector 4 and deposited on the filter 61, or generated in the filter 61 may be washed away into the fuel passage 5 by the fuel flow through the filter 61. For example, at restarting of the engine, the fuel vapor generated in the assembly 33 is prevented from being mixed with the fuel to be supplied to the engine, thereby ensuring smooth restarting of the engine even at a high engine temperature. Further, any noise caused by the reciprocation of the valve 11 of the injector 4 may be suppressed by the noise suppressing chamber 30A defined between the fuel injection system component 3 and the cover 30, so that the noise generated in the fuel injection system assembly 33 may be greatly reduced.

Figure 9:
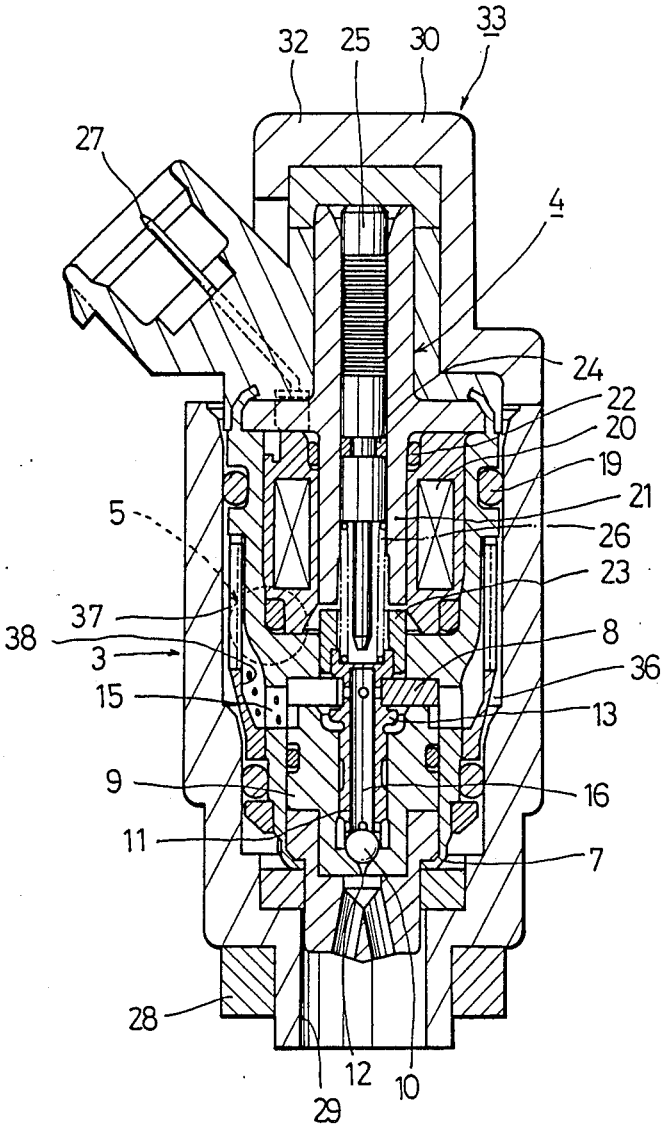
FIG. 9 is a sectional view of an injector for use with an assembly according to a fourth embodiment.

FIG. 9 shows an injector to be used in a fourth embodiment of the present invention. The injector 4 of this embodiment has a filter 37 corresponding to the filter 61 provided adjacent to the fuel inlet 15 of the injector 4 of the third embodiment. The filter 37 has a lower portion formed by a plate surface 38 having no filtering function. The plate surface 38 forms a plastic molded frame portion for holding a mesh, so that liquid fuel may be introduced along the plate surface 38 into the fuel inlet 15 of the injector 4. This structure can prevent turbulent flow of the fuel at the fuel inlet 15 of the injector 4 and ensure a stable metering accuracy of fuel.

In the third or fourth embodiment, the filter 61 or 37 is assembled in such a manner as to be inserted into the fuel passage 5 located at a position higher than the fuel inlet 15. Therefore, even when the fuel temperature in the fuel passage 5 and the temperature of the injector 4 are increased by the high engine temperature to cause generation of the fuel vapor in the injector 4, the fuel flow in the fuel passage 5 passes through the filter 61 or 37 of the injector 4 so as to wash away the fuel vapor in the filter 61 or 37. This prevents the fuel vapor generated in the injector 4 from being mixed with the fuel to be supplied to the engine, so that the startability, especially the restartability and the drivability of the engine may be stabilized, irrespective of the generation of the fuel vapor in the injector 4. Furthermore, as the fuel passage 5 of the component 3 and the filter 61 or 37 are located at a position higher than the fuel inlet 15, any turbulence of fuel flow due to branching of the fuel flow or flowing off of the fuel vapor into the fuel passage 5 can be smoothened in the vicinity of the fuel inlet 15 located at a position lower than the fuel passage 5, so that the metering accuracy of fuel may be stabilized.

In the fourth embodiment, the lower portion of the filter 37 adjacent to the fuel inlet 15 of the injector 4 is formed by the plate surface 38 having no filtering function so as to introduce the liquid fuel into the fuel inlet 15 along the plate surface 38. This effectively prevents turbulence of fuel flow at the fuel inlet 15, even if the distance from the fuel passage 5 to the fuel inlet 15 is relatively short, so that the metering accuracy of fuel may be more stabilized.

Figure 10:
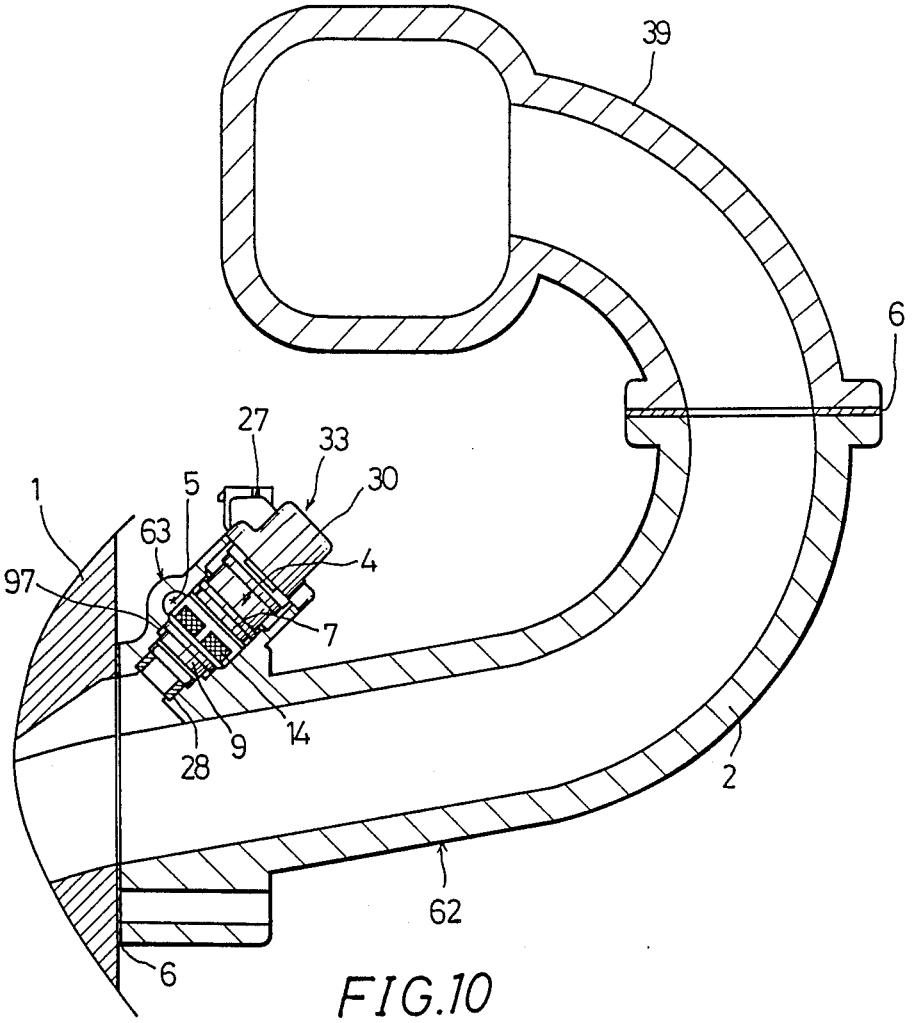
FIG. 10 is a sectional view of an assembly according to a fifth embodiment of the present invention, showing an injector in side elevation.
Figure 11:
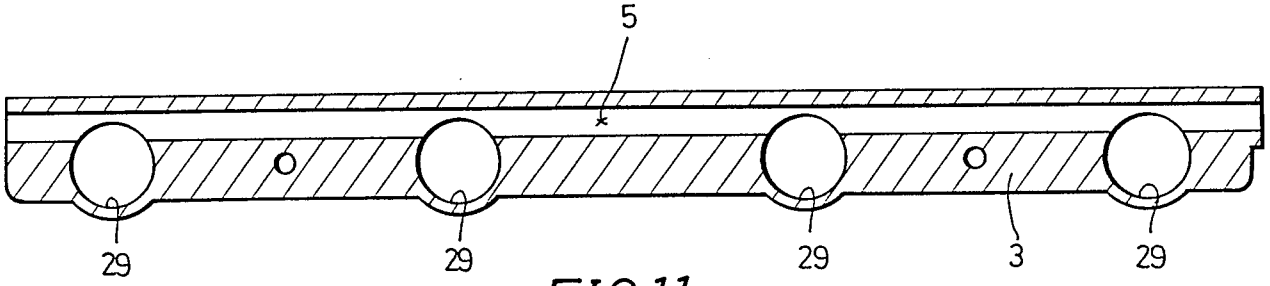
FIG. 11 is a sectional view of the fuel injection system component of the assembly shown in FIG. 10 as similar to FIG. 2.

Now, a fifth embodiment of the present invention will be described with reference to FIGS. 10 to 12.

An integral fuel injection system component 62 is mounted between a cylinder head 1 and a surge tank 39 through gaskets 6 and bolts (not shown). The component 62 comprises an intake manifold 2 and a fuel rail 63. The fuel rail 63 has a plurality of injector seats 97 for mounting a plurality of injectors 4 and has a fuel passage 5 for supplying fuel to the injectors 4. The component 62 is made of die cast aluminum.

Figure 12:
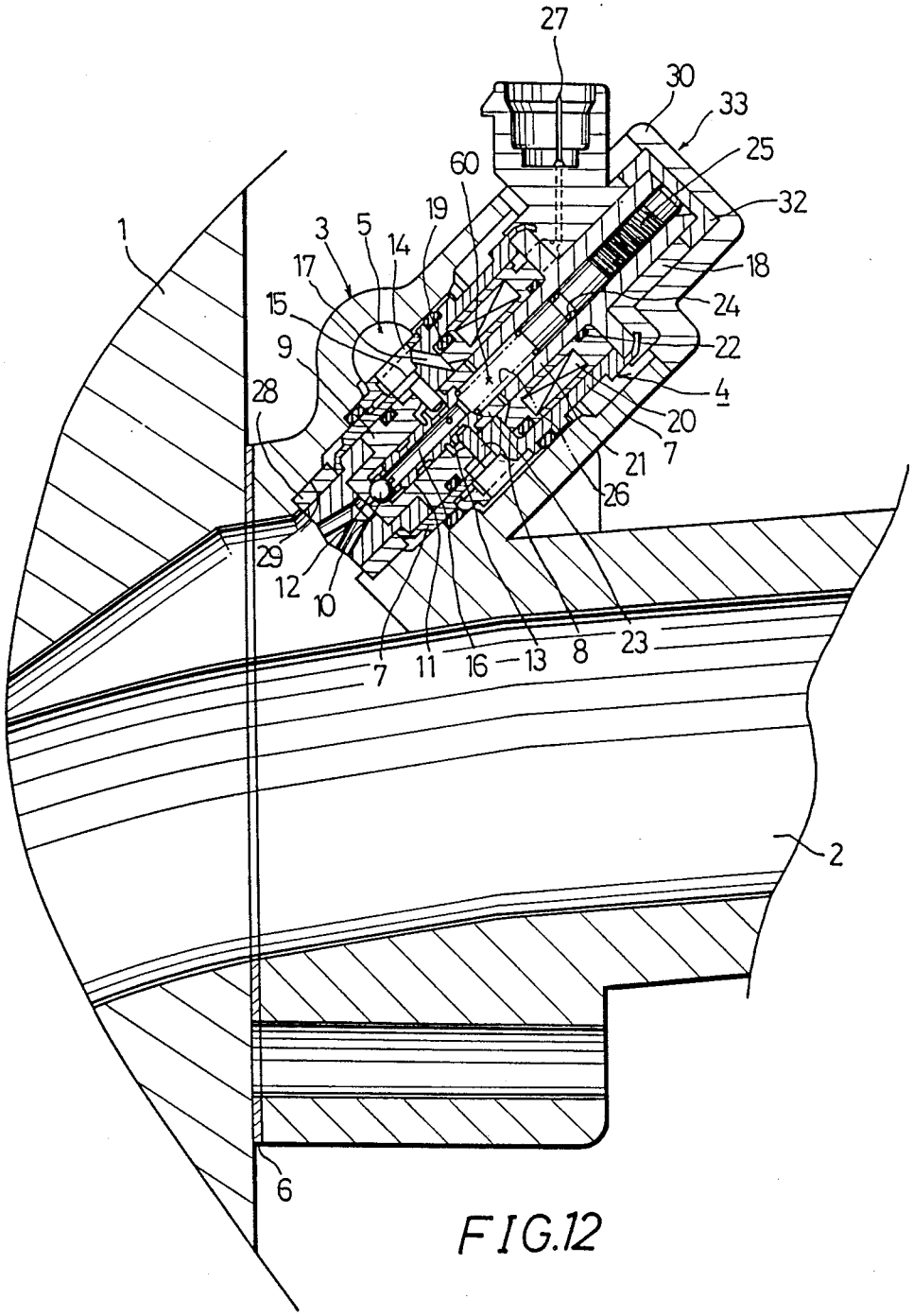
FIG. 12 is an enlarged sectional view of FIG. 10.

The injector 4 is shown in detail in FIG. 12, but as the basic construction thereof is similar to that of the first embodiment shown in FIG. 1, any more explanation will be omitted.

In this embodiment, as the fuel rail 63 is integrally formed with the intake manifold 62, the injectors 4 and the intake manifold 2 may be easily mounted and positioned, thereby reducing a manufacturing cost. Furthermore, as the operating noise in the reciprocating motion of the valve 11 generated from the injector 4 is directly transmitted to the intake manifold 2, unpleasant feeling due to the noise may be considerably relieved.

Even if the engine temperature is increased, the temperature of at least the fuel flowing through the fuel rail 63 can be kept relatively low, because the fuel rail 63 is formed of aluminum having a high radiating capability of cooling the fuel. Furthermore, as the fuel passage 5 of the fuel rail 63 is communicated with each other sideways of the valve 11, the velocity of fuel flow through the filter 14 corresponds to a fuel injection rate greatly slower than the velocity of fuel flow in the fuel passage 5 of the fuel rail 63. Therefore, the fuel vapor is hardly generated in the filter 14, thereby ensuring relatively smooth restarting of the engine even at a high engine temperature.

In this embodiment, even if the fuel vapor is generated in the fuel injection system assembly 33, it is once stored in a fuel storage chamber 60 at the rear end of the valve 11 and is then discharged therefrom through a vapor discharge passage 17 into the fuel passage 5 of the fuel rail 63 at a position higher than the fuel storage chamber 60. At restarting of the engine, for example, the fuel vapor generated in the injector 4 may be prevented from being mixed with the fuel to be supplied to the engine, thereby ensuring smooth restarting of the engine.

Although the fuel flow produced by the operation of a fuel pump at restarting of the engine tends to cause generation of fuel vapor at the filter 14 for filtering off foreign matter, the fuel vapor generated is also once stored in the fuel storage chamber 60 and is then discharged therefrom through the vapor discharge passage 17 into the fuel passage 5 of the fuel rail 63 at a position higher than the fuel storage chamber 60. This improves the operating efficiency of the engine, thereby permitting smooth restarting of the engine.

Figure 13:
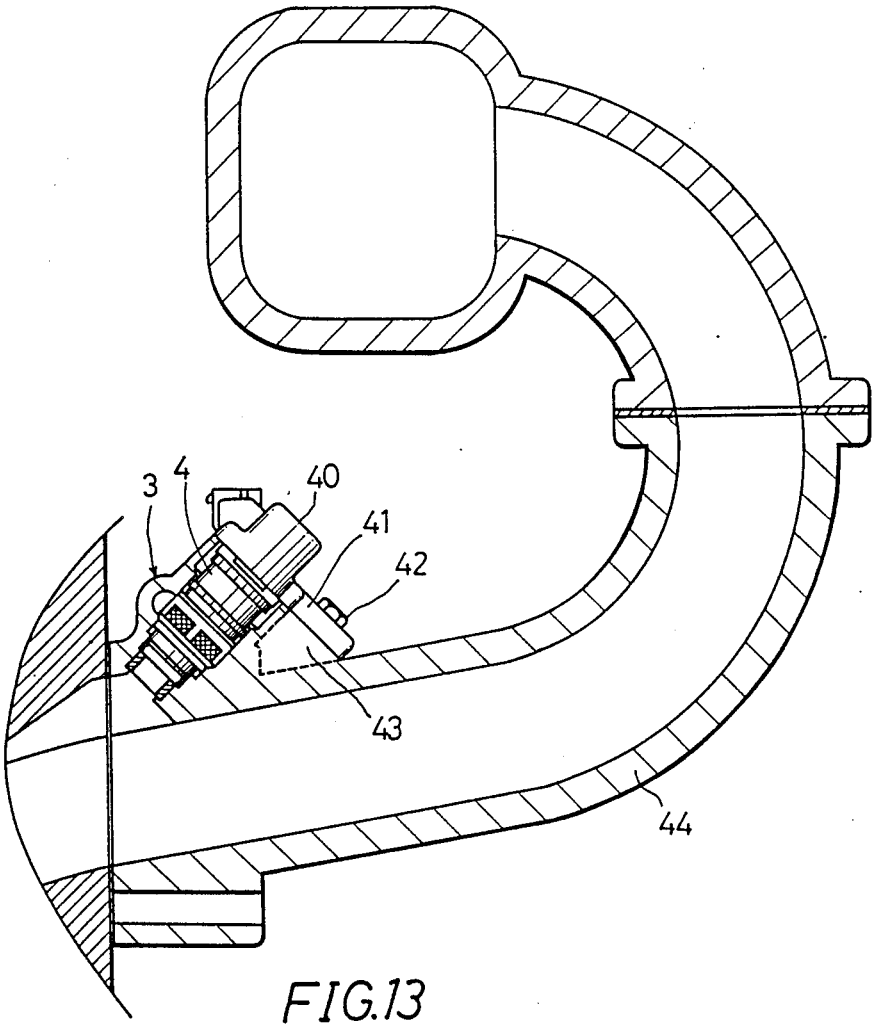
FIG. 13 is a sectional view similar to FIG. 10, illustrating a sixth embodiment of the present invention.
Figure 14:
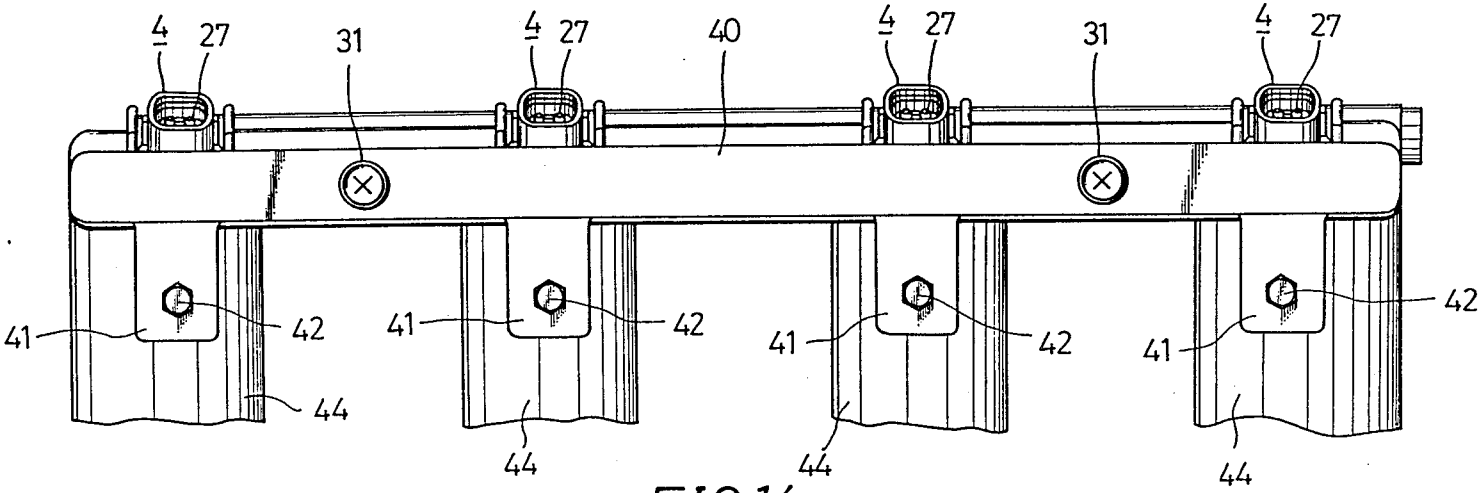
FIG. 14 is a front elevational view of the assembly according to the sixth embodiment.

FIGS. 13 and 14 show a sixth embodiment of the present invention, wherein a cover 40 is secured to a fuel rail 63 by fastening screws 31 so as to press the rear end surface of an injector 4 through a grommet and thereby to mount the injector 4 to the fuel rail 63. The cover 40 has projections 41 formed in opposition to an intake manifold 44 at positions corresponding to the respective cylinders. The intake manifold 44 has at a position corresponding to each injector 4 a boss 43 on which each projection 41 is mounted by fastening a bolt 42 so as to transmit an operating noise generated by the injector 4 to the intake manifold 44 and thereby to reduce the noise. This embodiment is substantially similar to the fifth embodiment in construction, operation and effect excepting the above aspect.

Figure 15:
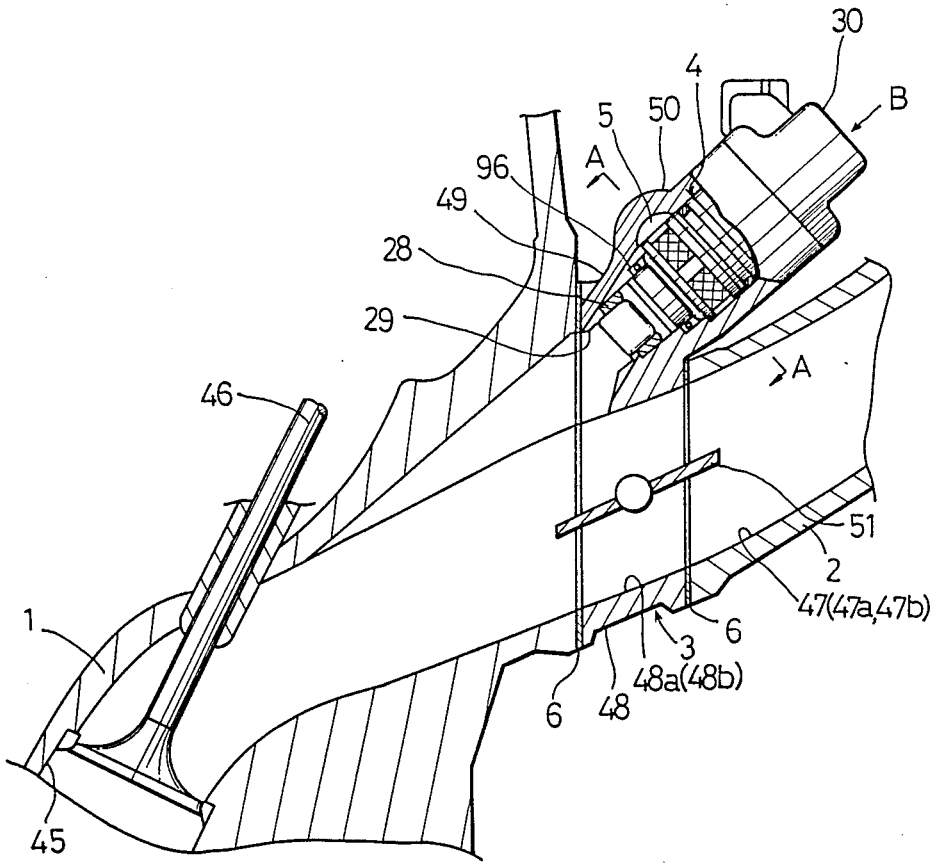
FIG. 15 is a sectional view of an assembly according to a seventh embodiment of the present invention, showing an injector in side elevation.
Figure 16:
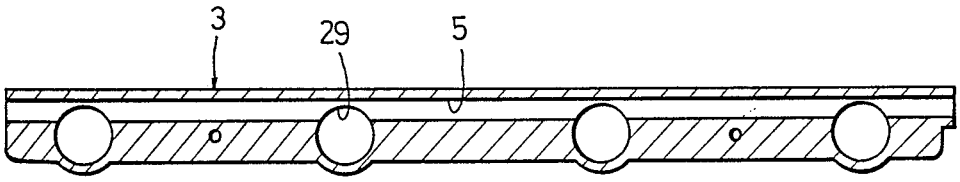
FIG. 16 is a sectional view of the fuel rail of the assembly shown in FIG. 15 as similar to FIG. 2.
Figure 17:
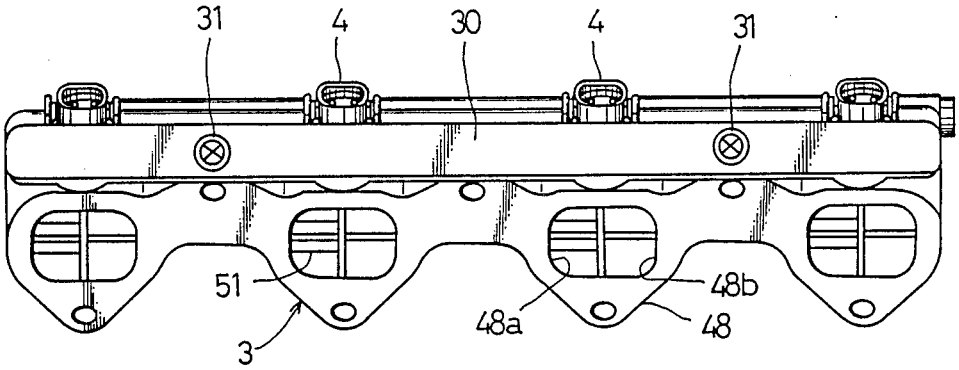
FIG. 17 is a front elevational view of the assembly according to the seventh embodiment.
Figure 18:
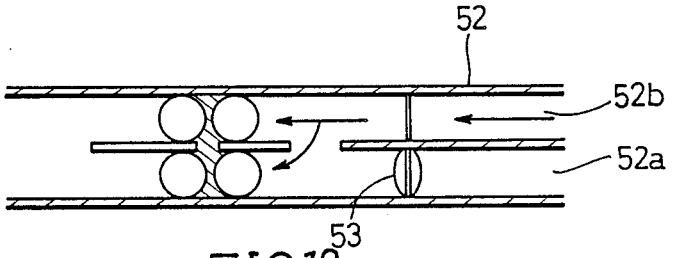
FIG.18 PRIOR ART
FIG. 18 is a view illustrating a suction and exhaust system for use with an engine having two suction ports for each cylinder in the prior art.
Figure 19:
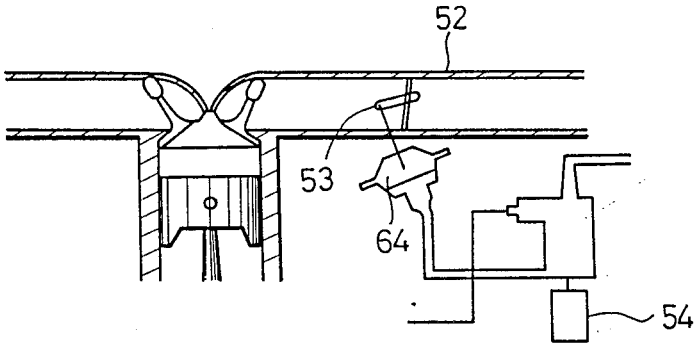
FIG.19 PRIOR ART
FIG. 19 is a sectional view of FIG. 18.

Now, the description will be directed to a seventh embodiment with reference to FIGS. 15 to 17. This embodiment relates to an assembly for use with an engine having two intake valves for each cylinder and two air passages in each intake manifold connected to each cylinder For the purpose of better understanding, a conventional fuel injection system of this type will be first explained with reference to FIGS. 18 and 19. The conventional fuel injection system employs a suction control system wherein an intake manifold 52 has a plurality of suction passages each divided into two passage sections **52*a* and 52*b* for each cylinder. An intake control valve 53 is mounted in the passage section 52*a*, and fuel is injected from an injector with two nozzle holes (not shown) toward respective suction ports of each cylinder. The suction control valve 53 is opened and closed in accordance with engine speed. A vacuum selector valve 54 is provided to select suction vacuum to be introduced into an actuator 64 of the suction control valve 53 according to an output signal from an engine control computer (not shown). In the low or medium engine speed range, the suction control valve 53 is closed to increase the velocity of air in the passage section 52*b***, thereby ensuring stabilized combustion and improving the fuel consumption.

In the conventional fuel injection system as mentioned above, the injector is generally mounted in such a manner that a delivery pipe (not shown) for supplying fuel to the injector is supported to the intake manifold directly mounted on the cylinder head and is connected with a fuel inlet of the injector, and nozzles of the injector are inserted into the air passages of the intake manifold 52. In other words, the delivery pipe is separate from the intake manifold 52.

This type of fuel injection system is disclosed in Japanese Utility Model Laid-Open Publication No. 61-88061 and Japanese Patent Laid-Open Publication No. 59-34473, for example.

However, the conventional fuel injection system is difficult to assemble, and it is necessary to keep a high machining accuracy of parts, which causes a high manufacturing cost.

Accordingly, the seventh embodiment of the present invention provides a fuel injection system assembly comprising a fuel injection component including in a unit a connection of an intake manifold with a cylinder head of an engine, a mounting portion for an injector and a delivery pipe. The component can be formed by die casting, so that cost may be reduced and machining accuracy may be improved, thereby permitting accurate assembling of the injector. During a low-speed engine operation, the injected fuel is carried by the air flow of different velocities controlled by the suction control valve, and it is supplied to the engine under a stratified atomized condition.

Referring to FIGS. 15 to 17, a cylinder head 1 carries suction valves 46 opening and closing suction ports 45. An intake manifold 2 forms suction passages 47 each divided into two passage sections 47*a* and 47*b* for each cylinder. A fuel injection system component 3 is interposed through gaskets 6 between the cylinder head 1 and the intake manifold 2 . The component 3 is integrally formed by die casting from aluminum, for example. The component 3 forms therein suction passage portions 48 each divided into two passage sections 48*a* and 48*b*, and has injector mounting portions 49 each having an injector seat 96 for receiving an injector 4 and an injector insertion hole 29 for inserting the nozzle of the injector 4. The injector mounting portion 49 is formed with a fuel passage portion 50 forming therein a fuel passage 5 communicated with each injector 4.

An intake control valve 51 is mounted in the passage section 48*a* of the suction passage portion 48. The injector 4 is inserted through a grommet 28 into the injector insertion hole 29 and is fixed therein by a cover 30. The injector 4 has two nozzle holes in correspondence with the two suction ports for each cylinder, and fuel injection therefrom is directed toward the respective suction ports of each cylinder.

As the fuel injection system component 3 is formed by die casting from aluminum, a good surface roughness may be obtained to thereby ensure accurate assembling of the injectors 4. During a low-speed operation of the engine, the intake control valve 51 in the passage section 48*a* is controlled to be in a fully closed position, so that a large part of suction air is permitted to flow through the other passage section 48*b*. The fuel injection from the two nozzle holes of the injector 4 is directed toward the respective suction ports 45 of each cylinder, and the injected fuel can be carried by the separate air flows in the passage sections 47*a*, 48*a* and 47*b*, 48*b* having different velocities. Therefore, fuel mixture of rich air-fuel ratio is supplied through the passage sections 47*a* and 48*a* carrying the suction control valve 51, while fuel mixture of lean air-fuel ratio is supplied through the passage sections 47*b* and 48*b*, so that a stratified mixture is supplied to the engine, so that stable combustion may be ensured. This results in improvement in drivability, fuel consumption and startability.

As described above, as the assembly of this embodiment is an integral component including the connecting portion 48 to be connected with the intake manifold 2 and the cylinder head 1, the mounting portion 49 for the injector 4 and the fuel passage section 50, the component can be formed by die casting, and the number of steps of finishing after die casting can be reduced, which contributes to a reduction in manufacturing cost.

Furthermore, as the injectors 4 are mounted in the injector mounting portions 49 formed by die casting, the assembling accuracy of the injectors 4 can be improved, which permits the injected fuel to be carried by the air flows having different velocities controlled by the intake control valve 51 during a low-speed engine operation, so that the stratified mixture can be supplied to the engine, with the result that fuel combustion may be made stable which contributes to the improvement in drivability, fuel consumption and startability.

Having thus described the preferred embodiments of the invention, it should be understood that numerous structural modifications and adaptations may be made without departing from the spirit of the invention.

What is claimed is:

1. An assembly for a fuel injection system for use with an internal combustion engine having a plurality of cylinders, said assembly being adapted to be mounted on a cylinder head of said engine, said assembly comprising:

(a) a fuel injection system component having:
- a plurality of air passages extending through said component;
- a plurality of injector seats each communicating with one of said air passages; and
- a fuel passage communicating with said injector seats; and (b) a plurality of injectors mounted on said injector seats, each injector having:
- a valve formed at a bottom portion of said injector communicating with one of said air passages;
- a fuel storage chamber formed within said injector at an upper part thereof and communicating with said valve;
- a fuel inlet communicating with said valve and said fuel passage; and
- a vapor discharge passage located above said fuel inlet and communicating with said fuel storage chamber and said fuel passage, wherein said vapor discharge passage inclines upwardly toward said fuel passage, whereby fuel vapor fed through said fuel inlet or generated in said injector is once stored in said fuel storage chamber and is then discharged from said fuel storage chamber through said vapor discharge passage into said fuel passage so as to prevent vapor lock of said injector system.

2. The assembly as defined in claim 1, wherein said vapor discharge passage extends to a position where velocity of fuel flow is higher than that at the other positions in said fuel passage so that fuel vapor in said fuel storage chamber is discharged through said vapor discharge passage into said fuel passage due to high suction pressure in said fuel passage.

3. The assembly as defined in claim 2, wherein said injector is mounted on said fuel injection system component so as to partially block said fuel passage by said injector whereby velocity of fuel flow around said injector is higher than that at the other positions in said fuel passage.

4. The assembly as defined in claim 1, wherein said injector further comprises a filter for filtering off foreign matter in fuel, wherein at least a part of said filter is inserted in said fuel passage so that fuel in said fuel passage flows through said part of said filter, whereby fuel vapor at said filter is washed away by the fuel flow in said fuel passage

5. The assembly as defined in claim 4, wherein said filter is mounted on said injector at a position higher than said fuel inlet, whereby the fuel flow in said fuel inlet is smoothened.

6. The assembly as defined in claim 1, wherein said engine comprises two suction ports for each cylinder, and said injector comprises two nozzle holes at a front end portion of said valve, and said injector is mounted on said component in a manner that fuel is injected from said two nozzle holes toward said two suction ports, respectively.

7. The assembly as defined in claim 6, wherein said component has two air passages for each cylinder and a plurality of intake control valves each mounted at one of said air passages for each cylinder, whereby mixture of rich air-fuel ratio is supplied through one of said suction ports into each cylinder, and mixture of lean air-fuel ratio is supplied through the other suction port into each cylinder under a closed condition of said intake control valve.

8. An assembly for a fuel injection system for use with an internal combustion engine having a plurality of cylinders, said assembly being adapted to be interposed between a cylinder head of said engine and a surge tank, said assembly comprising:

(a) a fuel injection system component having:
- a first mounting portion to be mounted on said cylinder head;
- a second mounting portion to be mounted on said surge tank;
- a plurality of air passages extending from said first mounting portion to said second mounting portion and forming an intake manifold;
- a plurality of injector seats each communicating with one of said air passages; and
- a fuel passage communicating with said injector seats; and (b) a plurality of injectors mounted on said injector seats, each injector having:
- vapor discharging means internally mounted in the injector for bypassing fuel vapor generated in the injector;
- a valve formed at a bottom portion of said injector communicating with one of said air passages; and
- a fuel inlet communicating with said valve and said fuel passage;

9. The assembly as defined in claim 8, wherein said injector is mounted on not only said injector seat but also said intake manifold.

10. The assembly as defined in claim 8, wherein said injector vapor discharging means comprises:
- a fuel storage chamber formed within said injector at an upper part thereof and communicating with said valve, and
- a vapor discharge passage located above said fuel inlet and communicating with said fuel storage chamber and said fuel passage, wherein said vapor discharge passage inclines upwardly toward said fuel passage, whereby fuel vapor fed through said fuel inlet or generated in said injector is once stored in said fuel storage chamber and is then discharged from said fuel storage chamber through said vapor discharge passage into said fuel passage so as to prevent vapor lock of said injector system.

11. A component for a fuel injection system for use with an internal combustion engine having a plurality of cylinders, said component being adapted to be interposed between a cylinder head of said engine and a surge tank, said component comprising:
- a first mounting portion to be mounted on said cylinder head;
- a second mounting portion to be mounted on said surge tank;
- a plurality of air passages extending from said first mounting portion to said second mounting portion and forming an intake manifold;
- a plurality of injector seats each communicating with one of said air passages;
- a plurality of injectors mounted on said injector seats, each injector having an internal fuel storage chamber;
- vapor discharging means within the injectors for bypassing fuel vapor generated in the injectors and stored in said internal fuel storage chamber; and
- a fuel passage communicating with said injector seats.

* * * * *